US012503280B2

(12) United States Patent
Kim

(10) Patent No.: US 12,503,280 B2
(45) Date of Patent: Dec. 23, 2025

(54) CONTAINER FOR DISCHARGING CONTENTS BY A FIXED AMOUNT INCLUDING A DROPPER AND PRESSURIZING PUMP

(71) Applicant: YONWOO CO., LTD., Incheon (KR)

(72) Inventor: Min Goo Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 279 days.

(21) Appl. No.: 18/275,774

(22) PCT Filed: Dec. 20, 2021

(86) PCT No.: PCT/KR2021/019404
§ 371 (c)(1),
(2) Date: Aug. 3, 2023

(87) PCT Pub. No.: WO2022/169097
PCT Pub. Date: Aug. 11, 2022

(65) Prior Publication Data

US 2024/0092542 A1 Mar. 21, 2024

(30) Foreign Application Priority Data

Feb. 3, 2021 (KR) ..... 10-2021-0015309

(51) Int. Cl.
*B65D 47/18* (2006.01)
*A45D 34/04* (2006.01)

(52) U.S. Cl.
CPC ..... *B65D 47/18* (2013.01); *A45D 34/04* (2013.01); *B65D 2547/06* (2013.01)

(58) Field of Classification Search
CPC ..... B65D 47/18; B65D 2547/06; A45D 34/04
(Continued)

(56) References Cited

U.S. PATENT DOCUMENTS

2013/0192713 A1 8/2013 Drugeon et al.
2015/0108173 A1* 4/2015 Kim ..... B05B 11/1015 222/256

(Continued)

FOREIGN PATENT DOCUMENTS

KR 20-2012-0002205 U 3/2012
KR 10-1215420 B1 12/2012

(Continued)

*Primary Examiner* — Brady W Frazier
(74) *Attorney, Agent, or Firm* — Bridgeway IP Law Group, PLLC; Sang Ho Lee; Hyun Woo Shin

(57) ABSTRACT

Provided is a container for discharging contents including: a body for accommodating the contents therein; and a dropper detachably coupled to top of the body to suck and discharge the contents of the body, the dropper including: a first cap detachably coupled to top of the body; a pipette coupled to the inside of the first cap to allow at least a portion to be accommodated in the body to suck the contents of the body; and button parts including: a pressurizing part for changing the internal pressure of the pipette by pressurization to discharge the contents of the body, an ascending and descending part ascended together with the pressurizing part according to the detachment of the dropper to allow the pressurizing part to protrude outward from the first cap, and an elastic part disposed between the pressurizing part and the ascending and descending part to provide an elastic force to the pressurizing part.

17 Claims, 10 Drawing Sheets

(58) Field of Classification Search
USPC ..... 239/374
See application file for complete search history.

(56) References Cited

U.S. PATENT DOCUMENTS

| | | | | |
|---|---|---|---|---|
| 2016/0058154 | A1* | 3/2016 | Jung | A45D 34/00 222/382 |
| 2019/0021470 | A1* | 1/2019 | Kim | A45D 34/043 |
| 2020/0154851 | A1* | 5/2020 | Jacob | B05B 11/1047 |
| 2020/0397116 | A1* | 12/2020 | Lee | B65D 81/3255 |
| 2022/0212842 | A1* | 7/2022 | Lee | A45D 34/04 |

FOREIGN PATENT DOCUMENTS

| | | | |
|---|---|---|---|
| KR | 20-2012-0008563 | U | 12/2012 |
| KR | 20-2018-0002602 | U | 8/2018 |
| KR | 10-2128583 | B1 | 7/2020 |
| KR | 10-2139321 | B1 | 7/2020 |
| KR | 10-2295985 | B1 | 9/2021 |

* cited by examiner

CONTAINER FOR DISCHARGING CONTENTS BY A FIXED AMOUNT INCLUDING A DROPPER AND PRESSURIZING PUMP

TECHNICAL FIELD

The present invention relates to a container for discharging the contents, more specifically to a container for discharging the contents thereof that is capable of drawing the contents thereof by a fixed amount therefrom.

BACKGROUND ART

As a method for using the liquid as the contents of cosmetic product by a fixed amount accurately while a small amount of liquid is being used at one time, in conventional practices, an individual packaging method in which the liquid type contents are packaged to the form of capsules with fixed amount of liquid to be used according to the number of times a user use the liquid contents. According to the individual packaging method, however, a relatively large amount of liquid remains in the capsule after the use of the capsule, and therefore, it can be appreciated that the existing individual packaging method is one of extremely inefficient methods.

To solve the problems the existing individual packaging method has had, a structure having a pipette type drawing means or pressurizing pump drawing means adapted to draw the contents of a container has been proposed.

In the case of the conventional pipette type drawing means, however, amounts of liquid sucked and drawn may be varied according to degrees of pressurization applied to a compression part made of rubber, and therefore, it is not easy to accurately draw a fixed amount whenever a user uses the liquid.

Even in the case of the pressurizing pump, amounts of liquid drawn may be varied according to degrees of pressurization applied to a nozzle or the amounts of liquid remaining in the nozzle, and further, the pressurizing pump has a metal spring disposed therein to provide an elastic force for repeated pumping operations, thereby raising the total manufacturing cost. Besides, the metal spring has to be thrown away after being separated from other components, thereby causing many difficulties in recycling.

Accordingly, there is a need to develop new technology capable of solving such problems.

DISCLOSURE

Technical Problem

Accordingly, the present invention has been made in view of the above-mentioned problems occurring in the related art, and it is an object of the present invention to provide a container for discharging the contents thereof that is capable of drawing the contents thereof by a fixed amount with ease through the separation of a dropper.

It is another object of the present invention to provide a container for discharging the contents thereof that is capable of allowing button parts including an elastic member to be made of the same type of material as other components thereof, thereby being easy to be thrown away and recycled.

The technical problems to be achieved through the present invention are not limited as mentioned above, and other technical problems not mentioned herein will be obviously understood by one of ordinary skill in the art through the following description.

Technical Solution

To accomplish the above-mentioned objects, according to the present invention, a container for discharging the contents thereof is provided. The container for discharging the contents thereof may include: a body for accommodating the contents therein; and a dropper detachably coupled to top of the body to suck and discharge the contents of the body, the dropper comprising: a first cap detachably coupled to top of the body; a pipette coupled to the inside of the first cap to allow at least a portion to be accommodated in the body to suck the contents of the body; and button parts comprising a pressurizing part for changing the internal pressure of the pipette by means of pressurization to discharge the contents of the body, an ascending and descending part ascended together with the pressurizing part according to the detachment of the dropper to allow the pressurizing part to protrude outward from the first cap, and an elastic part disposed between the pressurizing part and the ascending and descending part to provide an elastic force to the pressurizing part, wherein the button parts are ascended to a state where a first separation distance is kept between the underside of the pressurizing part and the underside of the ascending and descending part by means of the elastic part.

Desirably, the pressurizing part, the ascending and descending part, and the elastic part may be made of the same type of material.

Further, desirably, the pressurizing part may protrude from top of the first cap according to the separation of the dropper, and as the pressurizing part is pressurized, the elastic part may be compressed to change the first separation distance between the underside of the pressurizing part and the underside of the ascending and descending part into a second separation distance.

Further, desirably, the upper end portion of the ascending and descending part may be inserted into the pressurizing part, the ascending and descending part may have a first locking protrusion protruding from the outer peripheral surface of top end thereof, and the pressurizing part may have a second locking protrusion protruding inward from the inner peripheral surface thereof, so that when the pressurization against the pressurizing part is released, the first locking protrusion is locked onto the second locking protrusion to prevent the pressurizing part from escaping from the ascending and descending part.

Further, desirably, the ascending and descending part may have a support peripheral portion protruding outward from the outer peripheral surface of the lower end thereof, and the elastic part may be provided to the form of a bellows type member and thus seated onto top of the support peripheral portion to surround the outer peripheral surface of the ascending and descending part.

Further, desirably, the pressurizing part may have an extending portion extending from the bottom end periphery thereof to have a larger inner diameter than an inner diameter of the top end periphery thereof, and the upper end periphery of the elastic part may be accommodated in a separation space formed between the inner peripheral surface of the extending portion and the outer peripheral surface of the ascending and descending part.

Further, desirably, the ascending and descending part may have at least one or more ascending and descending protrusions, and the first cap may have at least one or more guide slits formed to given depths on the outer peripheral surface thereof to insert the ascending and descending protrusions thereinto, so that the ascending and descending protrusions move along the guide slits to allow the button parts to be ascended or descended.

Further, desirably, the dropper may further include a second cap coupled to the first cap to surround the first cap and rotating together with the button parts, so that if the second cap rotates in a first direction or in a second direction opposite to the first direction, the dropper may be separated from or coupled to the body.

Further, desirably, if the pressurizing part is pressurized by a user to discharge the contents of the body, the ascending and descending part may be supported against the ascending and descending protrusions and the guide slits to allow the elastic part to provide the elastic force to the pressurizing part.

Further, desirably, the second cap may have vertical grooves formed on the inner peripheral surface thereof to extend up and down, and the ends of the ascending and descending protrusions passing through the guide slits may be coupled to the vertical grooves, so that the rotary force applied to the second cap is transferred to the button parts.

Advantageous Effects

According to the present invention, the container can draw the contents thereof by a fixed amount therefrom through the detachment of the dropper from the body, thereby having many conveniences of use.

According to the present invention, further, the container can have the button parts made of the same type of material as other components thereof, so that the components of the container are unitarily thrown away and recycled, which is more eco-friendly.

According to the present invention, furthermore, the container can allow the elastic part to be compressedly deformed only when the dropper is separated from the body, thereby preventing the restoring force of the elastic part from being decreased when the container is kept to a given place or carried with the user.

BRIEF DESCRIPTION OF DRAWINGS

To allow the drawings as will be mentioned in the description of the present invention to be more sufficiently understood, a brief description of the drawings may be provided.

MODE FOR INVENTION

Figure 1:
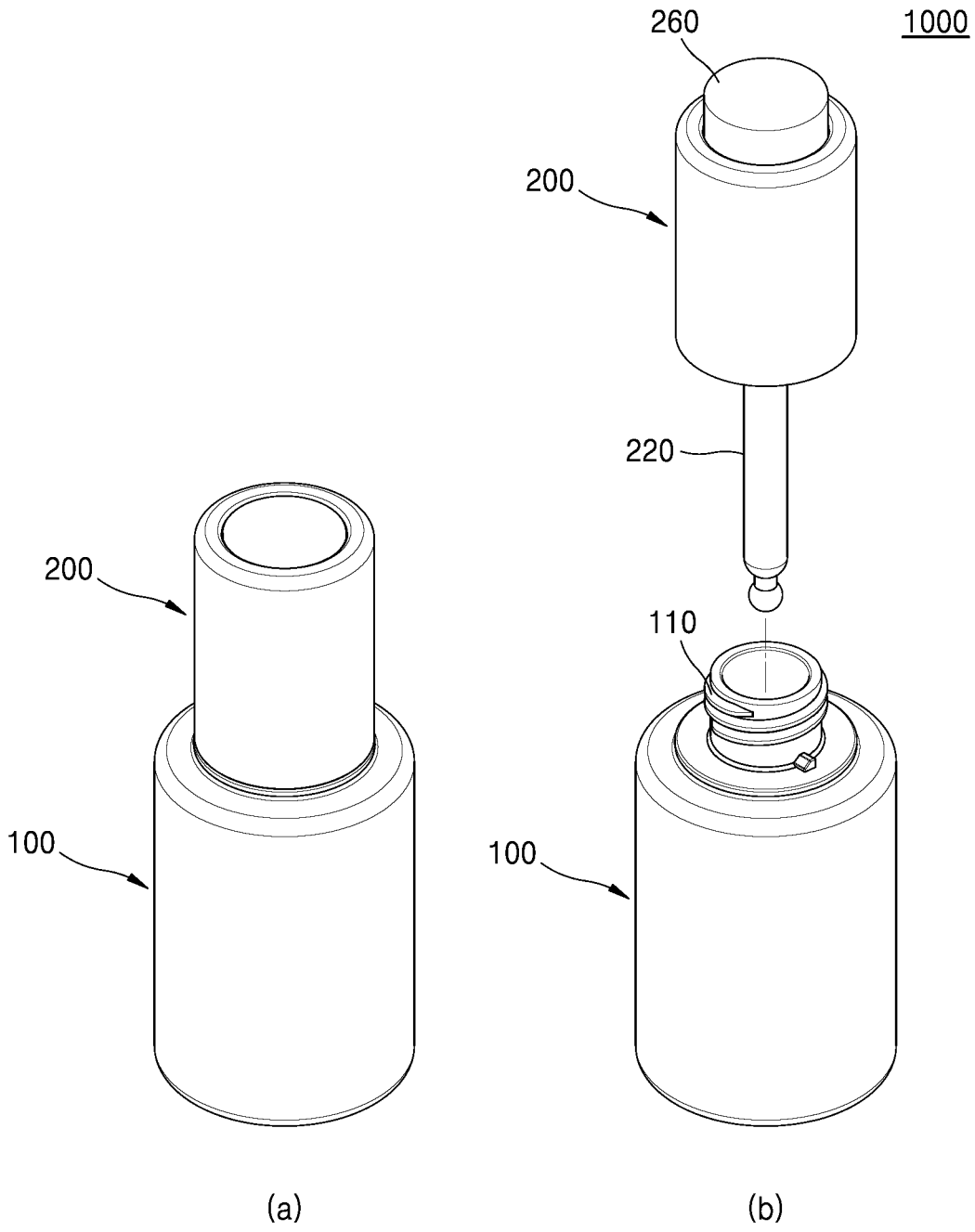
FIG. 1 is a perspective view showing a container for discharging the contents thereof according to the present invention.

Hereinafter, example embodiments will be described with reference to the accompanying drawings. However, for reference numerals, with respect to the same elements, even though they may be displayed in different drawings, such elements use the same reference numerals as much as possible. Also, in explaining the example embodiments, detailed description on known elements or functions will be omitted if it is determined that such descriptions will interfere with the understanding of the embodiments. In addition, the example embodiments may be embodied in different forms and should not be construed as limited to the embodiments set forth herein but may be modified and variously implemented by those skilled in the art. Further, top, bottom, left and right directions, as will be described below are determined with reference to the drawings, and accordingly, the scope of the present invention is not necessarily restricted to the corresponding directions.

In the description, when it is said that one element is described as being "connected" to the other element, one element may be directly connected or coupled to the other element, but it should be understood that another element may be present between the two elements. When it is said that one portion is described as "includes" any component, further, one element may further include other components unless no specific description is suggested. Also, in explaining elements, terms like "first", "second", "A", "B", "(a)", "(b)", etc. may be used. However, such terms are used to distinguish one from the others only and they do not affect the essence, nature, sequence, order, etc.

Figure 2:
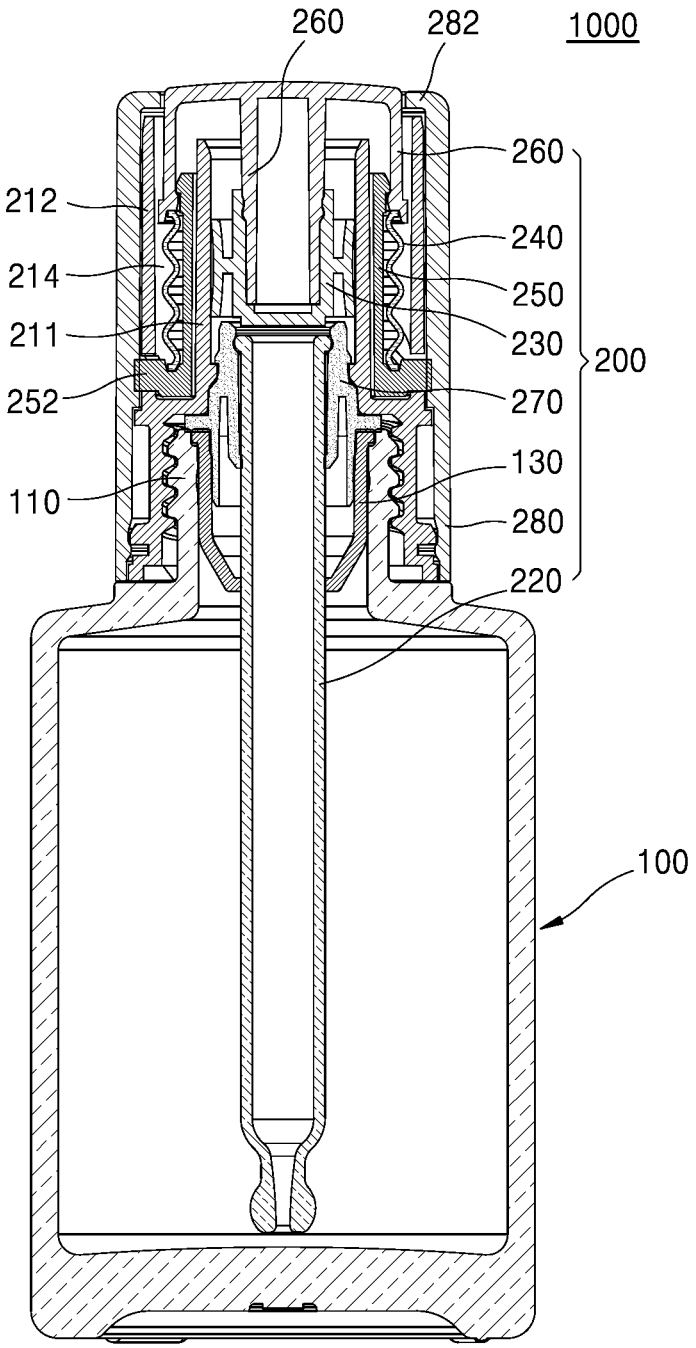
FIG. 2 is a sectional view showing the container for discharging the contents thereof according to the present invention.
Figure 3:
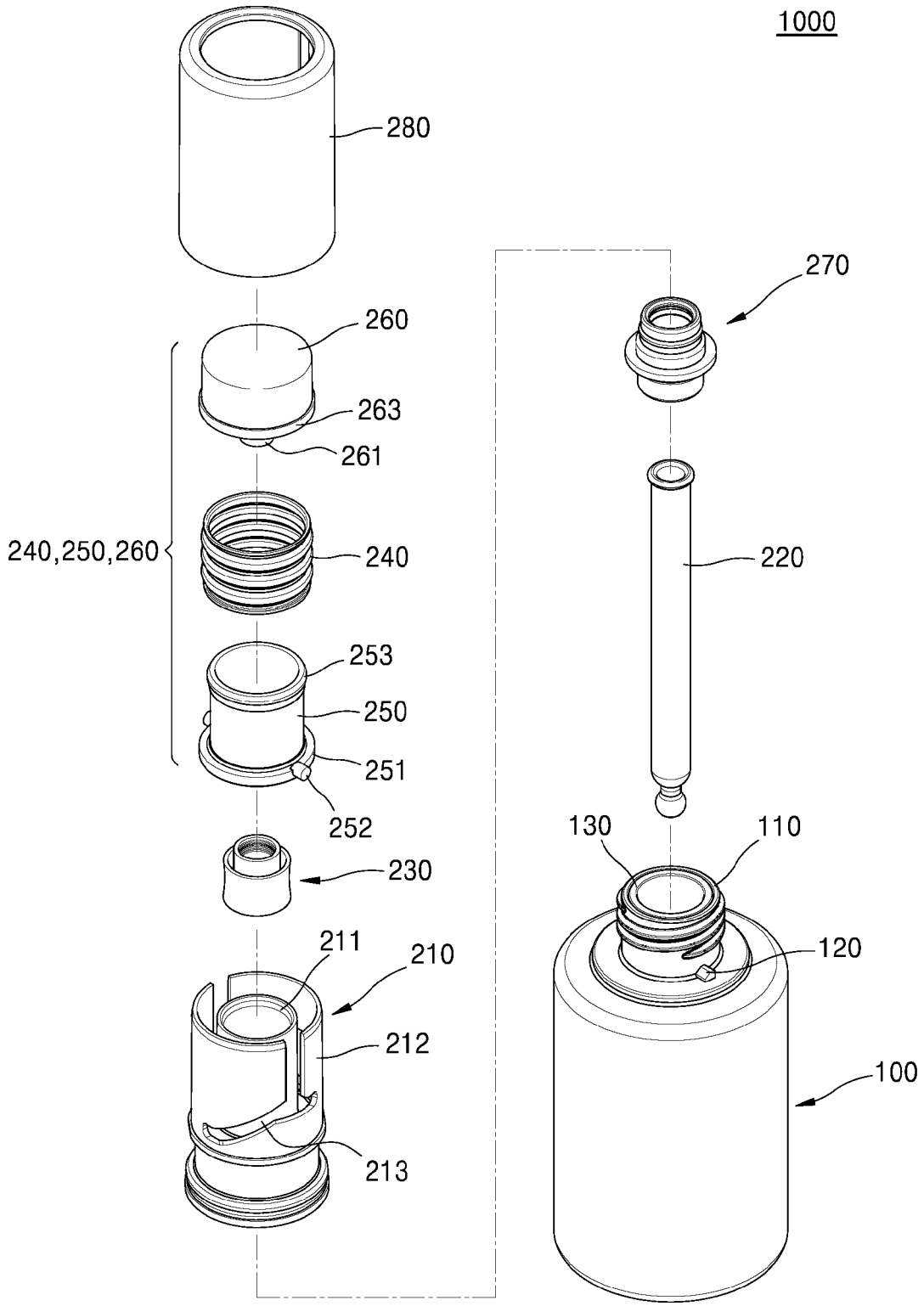
FIG. 3 is an exploded perspective view showing the container for discharging the contents thereof according to the present invention.
Figure 4:
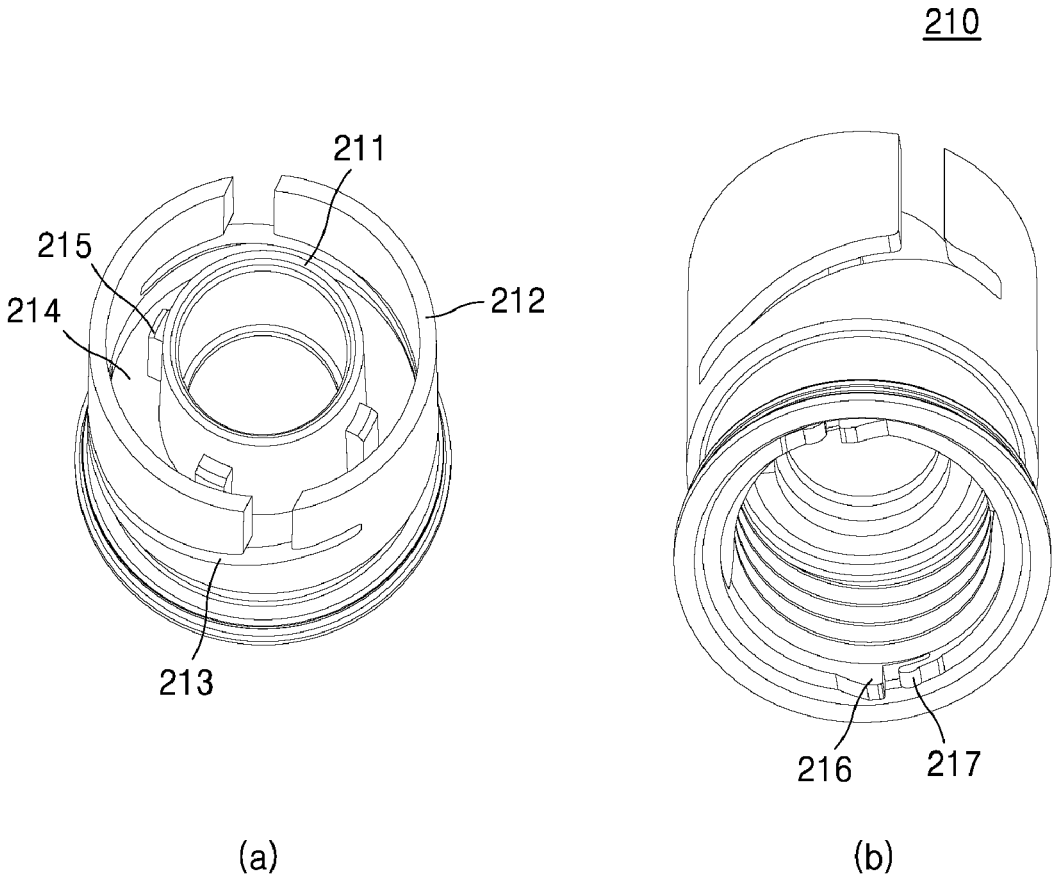
FIG. 4 is a perspective view showing a first cap of the container for discharging the contents thereof according to the present invention.
Figure 5:
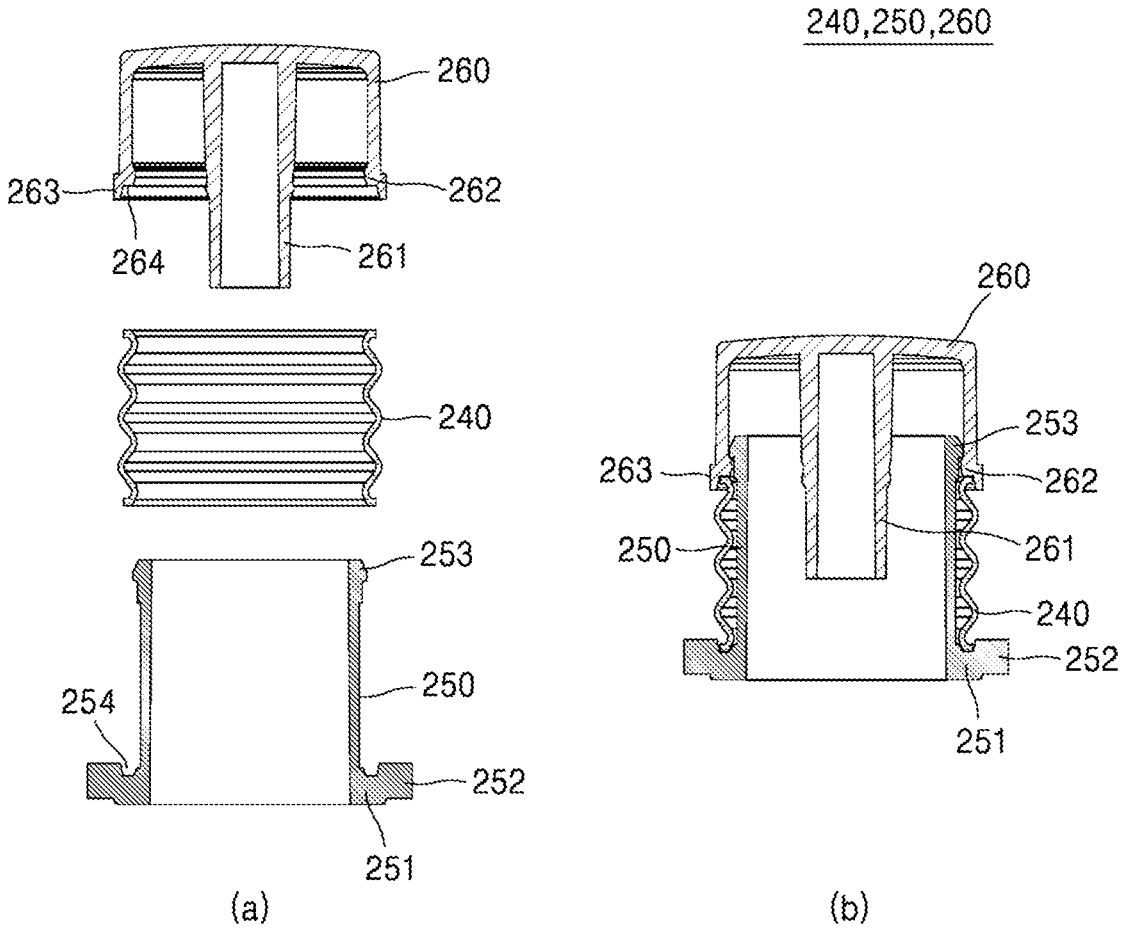
FIG. 5 is a sectional view showing button parts of the container for discharging the contents thereof according to the present invention.
Figure 6:
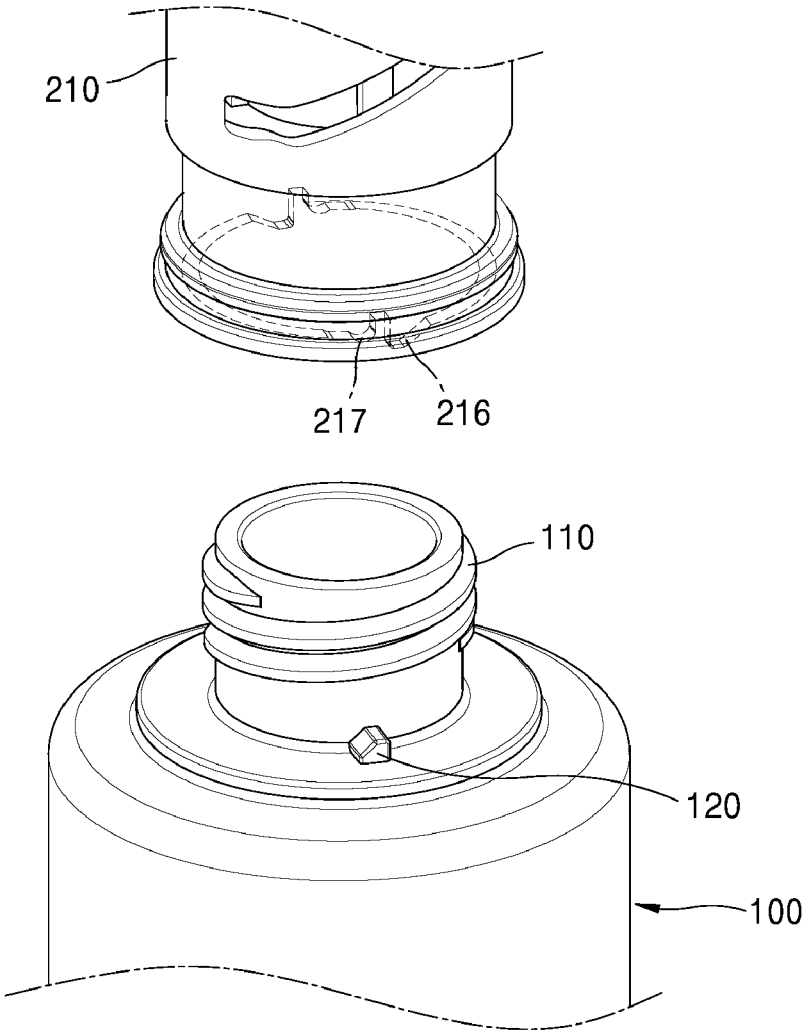
FIG. 6 is a perspective view showing a coupling relation between the first cap and a body of the container for discharging the contents thereof according to the present invention.
Figure 7:
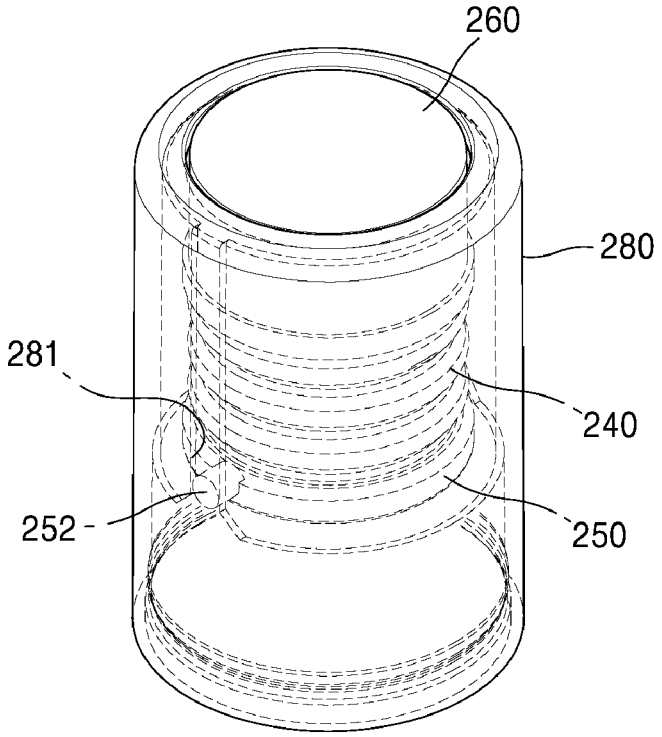
FIG. 7 is a perspective view showing a coupling relation between the button parts and a second cap of the container for discharging the contents thereof according to the present invention.

FIG. 1 is a perspective view showing a container for discharging the contents thereof according to the present invention, FIG. 2 is a sectional view showing the container for discharging the contents thereof according to the present invention, FIG. 3 is an exploded perspective view showing the container for discharging the contents thereof according to the present invention, FIG. 4 is a perspective view showing a first cap of the container for discharging the contents thereof according to the present invention, FIG. 5 is a sectional view showing button parts of the container for discharging the contents thereof according to the present invention, FIG. 6 is a perspective view showing a coupling relation between the first cap and a body of the container for discharging the contents thereof according to the present invention, and FIG. 7 is a perspective view showing a coupling relation between the button parts and a second cap of the container for discharging the contents thereof according to the present invention.

Referring to FIGS. 1 to 7, a container 1000 for discharging the contents thereof according to the present invention includes a body 100 and a dropper 200.

The body 100 provides an accommodation space in which the contents thereof are accommodated. The contents of the body 100 are sucked and discharged by means of a pipette 220 of the dropper 200 and thus applied to a user's given region. In this case, the contents of the body 100 are liquid or gel-phase fluids, such as cosmetics, medicines, and quasi-drugs like tooth paste, but the contents may include all types of materials capable of being sucked and discharged by means of the pipette 220, without being limited thereto. Further, the body 100 has the shape of a bottle, which is just exemplary, and accordingly, the body 100 may have various shapes, such as a tube and the like.

The body 100 has a discharge portion 110 formed on the center of top thereof and open on top thereof. The dropper 200 is detachably coupled to the discharge portion 110, while inserting the pipette 220 into the discharge portion 110. To do this, the discharge portion 110 has a screw thread formed on the outer peripheral surface thereof.

A wiper 130 is coupled to the inner peripheral surface of the discharge portion 110. The wiper 130 serves to remove the contents of the body 100 remaining on the outer peripheral surface of the pipette 220 when the pipette 220 is drawn from the body 100. The wiper 130 has a through hole (not shown) formed thereon to pass the pipette 220 therethrough.

The dropper 200 is detachably coupled to top (especially, the discharge portion 110) of the body 100, sucks the contents of the body 100 by a fixed amount, and discharges the sucked contents of the body 100 to the outside. The dropper 200 includes a first cap 210, the pipette 220, a seal cap 230, button parts 240, 250, and 260, a coupling part 270, and a second cap 280.

The first cap 210 supports other components of the dropper 200, guides the ascending and descending operations of the button parts 240, 250, and 260, and is detachably coupled to the discharge portion 110 of the body 100. To do this, the first cap 210 has a screw thread formed on the inner peripheral surface of the lower end thereof to correspond to the screw thread of the discharge portion 110.

The first cap 210 has a cylinder 211 formed at the inside thereof. The cylinder 211 communicates with the pipette 220 and allows the contents of the body 100 to be sucked to the inside of the pipette 220 or allows the sucked contents of the body 100 to be discharged to the outside in accordance with changes in internal pressure thereof.

Further, the first cap 210 has a peripheral portion 212 spaced apart from the cylinder 211 along the outer peripheral surface of the cylinder 211 to surround at least a given portion of the cylinder 211 and guide slits 213 formed to given depths on the outer peripheral surface of the peripheral portion 212. Ascending and descending protrusions 252 of the button parts 240, 250, and 260 are insertedly moved into the guide slits 213, and accordingly, the guide slits 213 serve to guide the button parts 240, 250, and 260 to be ascended or descended.

Further, an accommodation space 214 in which the button parts 240, 250, and 260 are accommodated is formed between the cylinder 211 and the peripheral portion 212. For example, the button parts (especially, the ascending and descending part 250) are accommodated inside the accommodation space 214, while surrounding the cylinder 211.

According to the present invention, the cylinder 211 has at least one or more separation protrusions 215 spaced apart from one another on the outer peripheral surface thereof to extend in upward and downward directions. The separation protrusions 215 serve to separate the inner peripheral surface of the ascending and descending part 250 from the cylinder 211 by a given distance. If the inner peripheral surface of the ascending and descending part 250 comes into close contact with the cylinder 211, the ascending and descending part 250 is not gently ascended and descended because of the friction against the cylinder 211, but the formation of the separation protrusions 215 enables the contact area between the cylinder 211 and the ascending and descending part 250 to be reduced, thereby decreasing the friction therebetween. Further, the separation protrusions 215 support the inner peripheral surface of the ascending and descending part 250, thereby preventing lateral movements of the ascending and descending part 250 from occurring.

The first cap 210 has at least one or more restriction protrusions 216 and 217 formed on the inner peripheral surface of the lower end thereof. The restriction protrusions 216 and 217 are locked onto restriction projections 120 formed on top of the body 100 to prevent the first cap 210 from being arbitrarily rotated and separated in a first direction by means of an unintended external force or from being excessively rotated in a second direction opposite to the first direction.

According to the present invention, the restriction protrusions 216 and 217 may be a pair of first and second protrusions 216 and 217 having different heights from each other. In this case, one or more pairs of restriction protrusions 216 and 217 are formed at different positions of the inner peripheral surface of the lower end of the first cap 210, and accordingly, the restriction projections 120 corresponding to the one or more pairs of limitations protrusions 216 and 217 are formed at different positions of the top of the body 100.

The first protrusions 216 serve to restrict the rotation of the first cap 210 in the second direction. For example, if the first cap 210 rotates in the second direction, together with the second cap 280, which will be discussed later, the first cap 210 is coupled to the discharge portion 110 of the body 100, and in the screw coupling process, the lower end periphery of the first cap 210 becomes gradually close to the top of the body 100. If the lower end periphery of the first cap 210 is close to the top of the body 100 by a given distance, the vertical surfaces formed at one side of the first protrusions 216 of the first cap 210 come into close contact with the vertical surfaces of the restriction projections 120 of the body 100, and accordingly, the first protrusions 216 restrict the rotation of the first cap 210 in the second direction. This is to prevent the button parts 240, 250, and 260 from being broken when an excessive force is applied to the ascending and descending protrusions 252 of the button parts 240, 250, and 260 applying a rotary force to the first cap 210.

The second protrusions 217 are spaced apart from the first protrusions 216 and restrict the rotation of the first cap 210 in the first direction. For example, in a state where the first cap 210 is completely coupled to the discharge portion 110 of the body 100, each restriction projection 120 is located between the first protrusion 216 and the second protrusion 217. In this case, the second protrusion 217 has a gently curved end portion and thus comes into contact with the slant surface of the restriction projection 120, so that only in the case where a given level of rotary force is applied in the first direction, the first cap 210 rotates in the first direction. Accordingly, the first cap 210 is prevented from being arbitrarily rotated and separated in the first direction by means of an unintended external force.

The pipette 220 is open on the bottom end thereof to provide a discharge hole (with no reference numeral), and the top end of the pipette 220 communicates with the cylinder 211 of the first cap 210, so that the pipette 220 sucks and discharges the contents of the body 100 according to the internal pressure changes of the cylinder 211.

For example, at least a portion of the pipette 220 is accommodated in the body 100 through the discharge portion 110 when the body 100 and the dropper 200 are coupled to each other. After that, if a negative pressure is formed inside the cylinder 211 according to the rotation for separating the dropper 200 from the body 100, the pipette 220 sucks the contents of the body 100 from the body 100. Further, the pipette 220 is drawn from the body 100 if the dropper 200 is completely separated from the body 100, and if a positive pressure is formed inside the cylinder 211 according to the pressurization of the button parts 240, 250, and 260, the pipette 220 discharges the sucked contents of the body 100 to the outside.

The seal cap 230 is disposed inside the cylinder 211 and ascended and descended in a state of coming into close contact with the inner peripheral surface of the cylinder 211 to change the internal pressure of the cylinder 211. For example, the seal cap 230 is coupled to the rod 261 of the button parts 240, 250, and 260 and thus ascended and descended together with the button parts 240, 250, and 260 according to the rotations for the separation and coupling of the dropper 200.

The button parts 240, 250, and 260 are accommodated in the inner upper periphery of the first cap 210 to surround the cylinder 211 and rotate together with the second cap 280 in the process of separating and coupling the dropper 200, so that they are ascended and descended. Further, at least a portion of the button parts 240, 250, and 260 protrudes outward from the first cap 210 when the dropper 200 is separated from the body 100, and the button parts 240, 250, and 260 discharge the sucked contents of the body 100 according to a user's pressurization thereagainst.

The button parts 240, 250, and 260 represent an elastic part 240, the ascending and descending part 250, and a pressurizing part 260.

The elastic part 240 is disposed between the ascending and descending part 250 and the pressurizing part 260 and provides an elastic force to top of the pressurizing part 260.

The elastic part 240 is coupled to the ascending and descending part 250 to surround the outer peripheral surface of the ascending and descending part 250. The underside of the elastic part 240 is supported against the ascending and descending part 250, and the top thereof against the pressurizing part 260. If the pressurizing part 260 is pressurized by the user, the elastic part 240 is compressedly deformed to cause the pressurizing part 260 to be descended, and if the pressurization is released, the pressurizing part 260 returns to its original position by means of the elastic force of the elastic part 240.

According to the present invention, the elastic part 240 may be provided to the form of a bellows type member. However, the elastic part 240 may be formed of various deformable elastic members, without being limited thereto.

The ascending and descending part 250 penetrates up and down to form a hollow portion therein and is disposed under the pressurizing part 260, so that according to the detachment of the dropper 200, the ascending and descending part 250 is ascended together with the elastic part 240 and the pressurizing part 260 to cause the pressurizing part 260 to protrude outward from the first cap 210.

The ascending and descending part 250 has a support peripheral portion 251 protruding outward from the outer peripheral surface of the lower end thereof. The support peripheral portion 251 serves to support the underside of the elastic part 240. In specific, as the ascending and descending part 250 is inserted into the elastic part 240, the underside of the elastic part 240 is seated onto top of the support peripheral portion 251.

According to the present invention, at least one or more accommodation grooves 254 are formed on top of the support peripheral portion 251. For example, the accommodation grooves 254 are concavely formed on connected portions between the support peripheral portion 251 and the ascending and descending protrusions 252 to fix the underside of the elastic part 240. That is, when the underside of the elastic part 240 is seated onto the support peripheral portion 251, at least some of the lower periphery of the elastic part 240 are accommodated in the accommodation grooves 254, thereby allowing the underside of the elastic part 240 to be fixed to the support peripheral portion 251. Further, if the elastic part 240 is a bellows type member, the accommodation grooves 254 prevent the underside of the elastic part 240 from being deformed outward even under the repeated use of the elastic part 240, thereby keeping the performance of the elastic part 240 and extending the life time thereof.

The ascending and descending part 250 has the at least one or more ascending and descending protrusions 252 adapted to separate or couple the dropper 200 from or to the body 100 and to be ascended and descended. According to the present invention, the ascending and descending protrusions 252 protrude outward from the outer peripheral surface of the support peripheral portion 251. For example, the ascending and descending protrusions 252 are formed on both facing sides of the support peripheral portion 251.

The ascending and descending protrusions 252 are inserted into the guide slits 213 formed on the first cap 210, and if the second cap 280 rotates in the first direction or in the second direction opposite to the first direction to separate or couple the dropper 200 from or to the body 100, the ascending and descending protrusions 252 move along the guide slits 213 to allow the button parts 240, 250, and 260 to be ascended and descended together.

As top of the ascending and descending part 250 is inserted into the pressurizing part 260, the ascending and descending part 250 is coupled to the pressurizing part 260, and a given region of the ascending and descending part 250 comes into close contact with the inner peripheral surface of the pressurizing part 260 to guide the pressurizing part 260 to be ascended and descended.

The ascending and descending part 250 has a first locking protrusion 253 adapted to prevent the pressurizing part 260 from escaping therefrom. For example, the first locking protrusion 253 protrudes from the outer peripheral surface of top end of the ascending and descending part 250. When the pressurizing part 260 is ascended after it has been descended and then released from the pressurization, the first locking protrusion 253 is locked onto a second locking protrusion 262 formed on the inner peripheral surface of the pressurizing part 260 to prevent the pressurizing part 260 from escaping from the ascending and descending part 250.

At least a portion of the pressurizing part 260 is exposed to the outside in a process of separating the dropper 200 from the body 100, and the pressurizing part 260 ascends the seal cap 230 coupled thereto to allow the contents of the body 100 to be sucked to the pipette 220. After the dropper 200 is completely separated from the body 100, further, the pressurizing part 260 is pressurized by the user to discharge the contents of the pipette 220 to the outside.

The pressurizing part 260 has the rod 261 extending downward from top of the inside thereof. The end portion of the rod 261 is fittedly coupled to the seal cap 230, thereby coupling the pressurizing part 260 to the seal cap 230.

The pressurizing part 260 has the second locking protrusion 262 protruding from the inner peripheral surface of the lower end thereof. In a process where the pressurizing part 260 is ascended, the second locking protrusion 262 is locked onto the first locking protrusion 253 formed on the outer peripheral surface of the ascending and descending part 250, thereby preventing the pressurizing part 260 from escaping from the ascending and descending part 250.

The pressurizing part 260 has an extending portion 263 extending from the bottom end periphery thereof to have a larger inner diameter than an inner diameter of the top end periphery thereof. The extending portion 263 serves to accommodatedly support the upper end periphery of the elastic part 240. For example, if the ascending and descending part 250 is inserted into the lower side of the pressurizing part 260, the extending inner diameter of the extending portion 263 allows a separation space to be formed between the outer peripheral surface of the ascending and descending part 250 and the extending portion 263, and accordingly, the upper end periphery of the elastic part 240 is accommodated in the separation space. Further, the extending portion 263 supports the outer peripheral surface of the upper end of the elastic part 240 to prevent the upper end periphery of the elastic part 240 from being deformed even under the repeated use.

According to the present invention, the pressurizing part 260 has a stepped projection 264 formed on the inside thereof to support top of the elastic part 250. For example, the stepped projection 264 is formed on top end periphery of the inside of the extending portion 263 because the inner diameter of the extending portion 263 extends, and top of the elastic part 240 comes into close contact with the stepped projection 264. If the pressurizing part 260 is pressurized by the user, the external force caused by the pressurization is transferred to the elastic part 240 through the stepped projection 264.

According to the present invention, the elastic part 240, the ascending and descending part 250, and the pressurizing part 260 are made of the same type of material. For example, the elastic part 240, the ascending and descending part 250, and the pressurizing part 260 are made of the same type of synthetic resin (or plastic) material as other components of the container 1000. When the container 1000 is thrown away, accordingly, there is no need to separate the button parts (particularly, the elastic part 240) from other components of the container 1000, so that the container 1000 according to the present invention is eco-friendly.

According to the present invention, a distance between the underside of the pressurizing part 260 and the underside of the ascending and descending part 250 is changed according to whether the elastic part 240 is compressed or not. For example, in a state where the pressurizing part 260 is not pressurized by the user, a first separation distance is kept between the underside of the pressurizing part 260 and the underside of the ascending and descending part 250 by means of the elastic force of the elastic part 240. The first separation distance is still kept in the process where the button parts 240, 250, and 260 are ascended and descended. That is, if the second cap 280 rotates in the first direction or in the second direction opposite to the first direction to separate or couple the dropper 200 from or to the body 100, the button parts 240, 250, and 260 are ascended from the inside of the first cap 210 or descended toward the inside of the first cap 210, while the first separation distance is being kept between the underside of the pressurizing part 260 and the underside of the ascending and descending part 250. Contrarily, if the pressurizing part 260 is pressurized by the user in the state of being protrudingly exposed to the outside by means of the separation of the dropper 200, the elastic part 240 is compressed to descend the pressurizing part 260, and accordingly, the first separation distance between the underside of the pressurizing part 260 and the underside of the ascending and descending part 250 is changed into a second separation distance, so that the contents of the pipette 220 are discharged to the outside.

The coupling part 270 serves to couple the pipette 220 to the first cap 210 so that the pipette 220 communicates with the cylinder 211 and to seal the underside of the cylinder 211. For example, the coupling part 270 has a through hole (with no reference numeral) formed at the center thereof to insertedly fix the upper end periphery of the pipette 220 thereto, and in this state, the coupling part 270 is fitted to the inside of the cylinder 211 to allow the upper end periphery of the pipette 220 to communicate with the cylinder 211.

The second cap 280 is coupled to the first cap 210 to surround the first cap 210 and rotates according to the control of the user. The second cap 280, the button parts 240, 250, and 260, and/or the first cap 210 rotate together to allow the dropper 200 to be separated from or coupled to the body 100.

The second cap 280 has vertical grooves 281 formed on the inner peripheral surface thereof to extend up and down by a given length. The ends of the ascending and descending protrusions 252 passing through the guide slits 213 of the first cap 210 are coupled to the vertical grooves 281, and accordingly, the rotary force applied to the second cap 280 is transferred to the button parts 240, 250, and 260, so that the button parts 240, 250, and 260 rotate together with the second cap 280. Further, the second cap 280 has a circular locking protrusion 282 formed on the inner periphery of top thereof to prevent the button parts 240, 250, and 260 from escaping therefrom.

Figure 8:
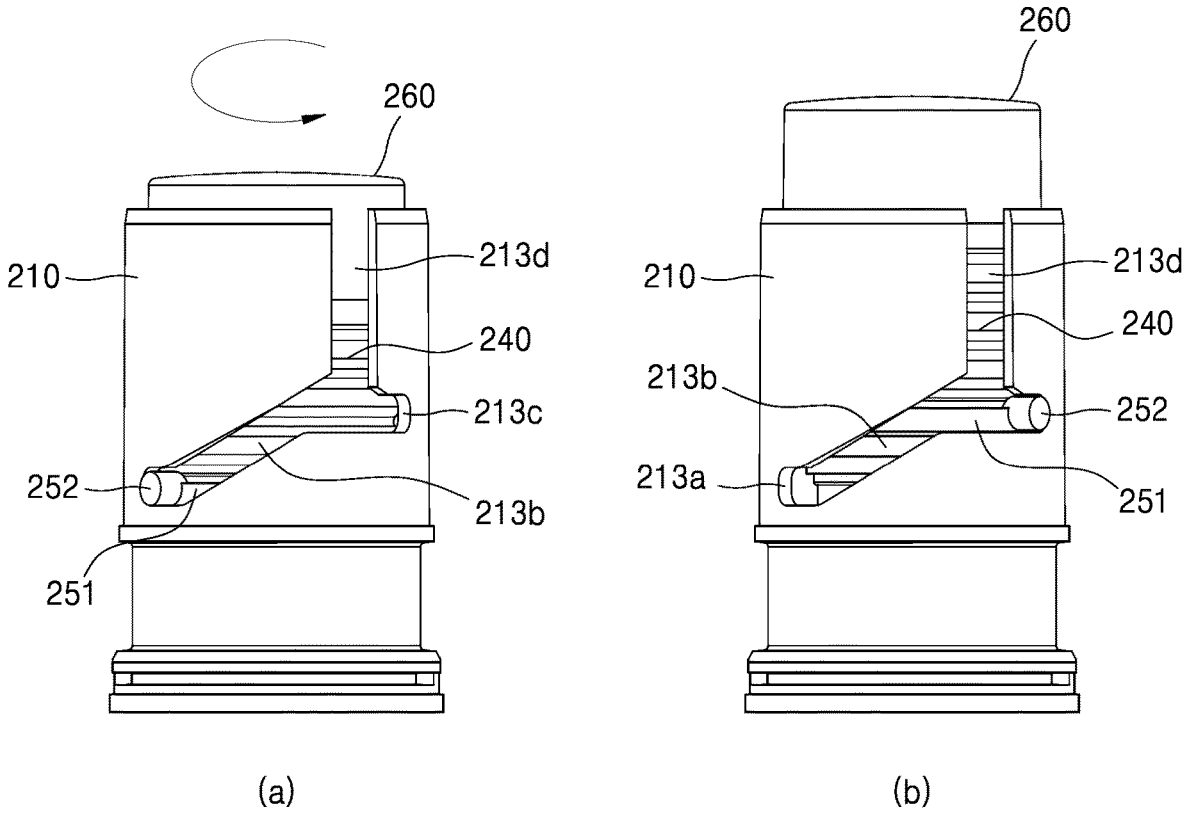
FIGS. 8 and 9 show exemplary operations of the container for discharging the contents thereof according to the present invention.
Figure 9:
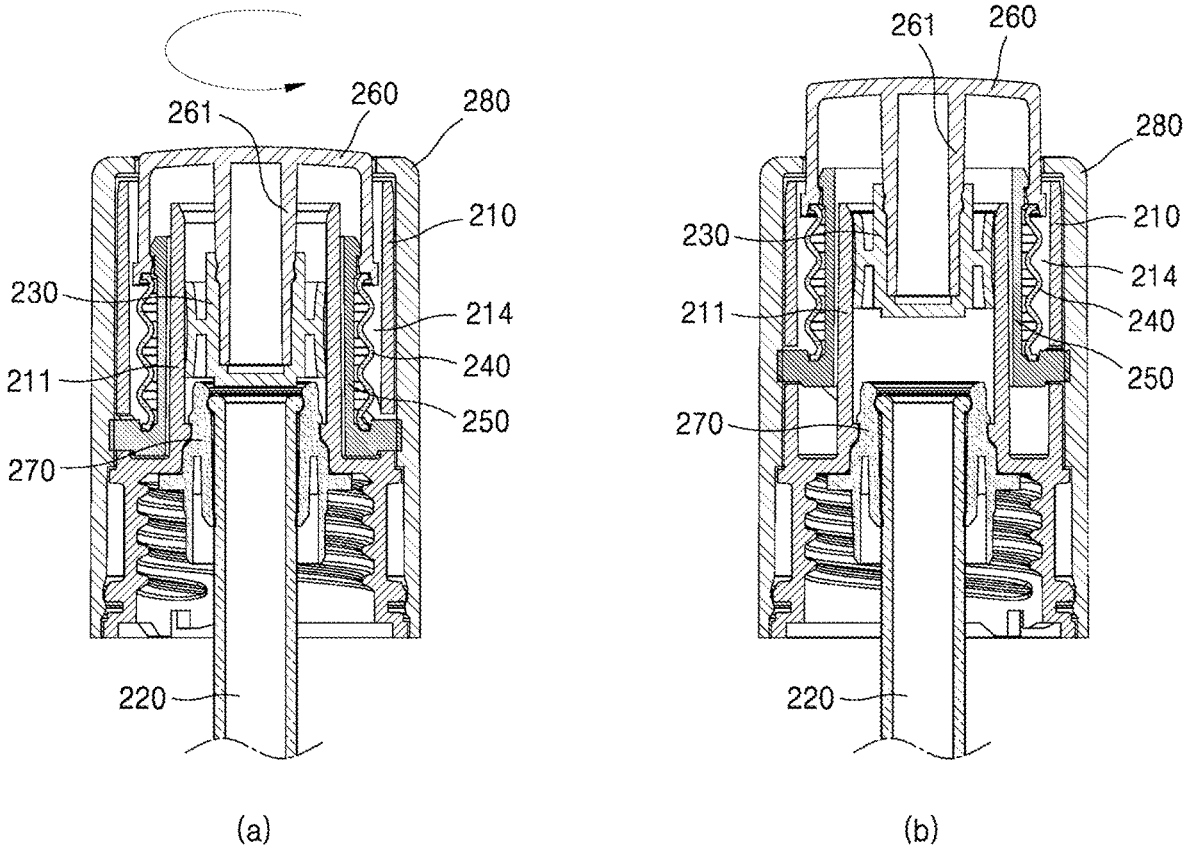

FIGS. 8 and 9 show exemplary operations of the container for discharging the contents thereof according to the present invention. In specific, FIGS. 8 and 9 show operations in which the button parts are ascended according to the separation of the dropper to suck the contents of the body to the pipette.

As shown in FIG. 8, each guide slit 213 of the first cap 210 includes a first slit 213*a* formed horizontally at the end thereof toward the second direction, a second slit 213*b* slant upward from the first slit 213*a* toward the first direction, and a third slit 213*c* formed horizontally at the end thereof toward the first direction.

According to the present invention, each guide slit 213 further includes a fourth slit 213*d* cut (passing) up to top end periphery of the first cap 210 from given regions of the second slit 213*b* and/or the third slit 213*c* to allow the first cap 210 to be easily coupled or separated to or from the button parts 240, 250, and 260. According to the present invention, the first slit 213*a* and the third slit 213*c* have locking projections (with no reference numerals) formed on given regions thereof to allow the ascending and descending protrusions 252 to escape therefrom only when a given level of rotary force is applied by the user.

Referring first to (a) of FIG. 8 and (a) of FIG. 9, in the state where the dropper 200 is completely coupled to the body 100, the ascending and descending protrusions 252 of the button parts 240, 250, and 260 are located inside the first slits 213*a*, and the elastic part 240 is seated onto the lower portion of the accommodation space 214. In this case, the seal cap 230 is located close to the top of the pipette 220 on the lower portion of the inside of the cylinder 211. As the elastic part 240 is not compressed, further, the first separation distance is kept between the underside of the pressurizing part 260 and the underside of the ascending and descending part 250 of the button parts 240, 250, and 260.

Referring next to (b) of FIG. 8 and (b) of FIG. 9, if the second cap 280 rotates in the first direction to separate the dropper 200 from the body 100, the button parts 240, 250, and 260 rotate in the first direction together with the second cap 280. In this case, the first cap 210 is kept stopped, and the ascending and descending protrusions 252 escape from the first slits 213*a* of the first cap 210 and move upward along the second slits 213*b* in the first direction, so that the button parts 240, 250, and 260 are ascended together with the seal cap 230.

Accordingly, the internal pressures of the cylinder 211 and the pipette 220 are changed, and the contents of the body 100 are sucked to the pipette 220. In this case, the pressurizing part 260 protrudes outward from the second cap 280. Even in the ascending process of the button parts 240, 250, and 260, the first separation distance is kept between the underside of the pressurizing part 260 and the underside of the ascending and descending part 250.

If the second cap 280 is kept rotating in the first direction by the user, the ascending and descending protrusions 252 move upward up to the ends of the second slits 213*b* and are then accommodated in the third slits 213*c*. After that, the ascending and descending protrusions 252 come into contact with the end surfaces of the third slits 213*c* to pressurize the end surfaces of the third slits 213*c*, so that the rotary force is transferred to the first cap 210, and next, the first cap 210 rotates in the first direction together with the second cap 280, thereby separating (that is, being released from the screw coupling) the dropper 200 from the discharge portion 110 of the body 100.

In this case, the ascending and descending part 250 is supported by the ascending and descending protrusions 252 accommodated in the third slits 213*c*, and accordingly, the elastic part 240 provides the elastic force to the pressurizing part 260 in a direction toward the pressurizing part 260. If the pressurizing part 260 is pressurized by the user, the elastic part 240 is compressed to change the distance between the underside of the pressurizing part 260 and the underside of the ascending and descending part 250 into the second separation distance, and accordingly, the sucked contents of the pipette 220 are discharged to the outside.

Contrarily, if the second cap 280 rotates in the second direction to couple the dropper 200 to the body 100, the ascending and descending protrusions 252 operate in the opposite processes to the above-mentioned processes. In specific, the ascending and descending protrusions 252 move from the third slits 213*c*, pass through the second slits 213*b*, and are accommodated in the first slits 213*a*, and in this process, the button parts 240, 250, and 260 and the seal cap 230 are descended again. After that, the ascending and descending protrusions 252 come into contact with the end surfaces of the first slits 213*a* to pressurize the end surfaces of the first slits 213*a*, so that the rotary force is transferred to the first cap 210, and next, the first cap 210 rotates in the second direction together with the second cap 280, thereby coupling the dropper 200 to the discharge portion 110 of the body 100. In the descending process of the button parts 240, 250, and 260, further, the first separation distance is kept between the underside of the pressurizing part 260 and the underside of the ascending and descending part 250.

Like this, the ascending and descending protrusions 252 move along the guide slits 213, thereby more stably performing the ascending or descending processes of the button parts 240, 250, and 260 and preventing the pressurizing part 260 from being pressurized by an external force to avoid the contents of the body 100 from being unintendedly discharged.

Figure 10:
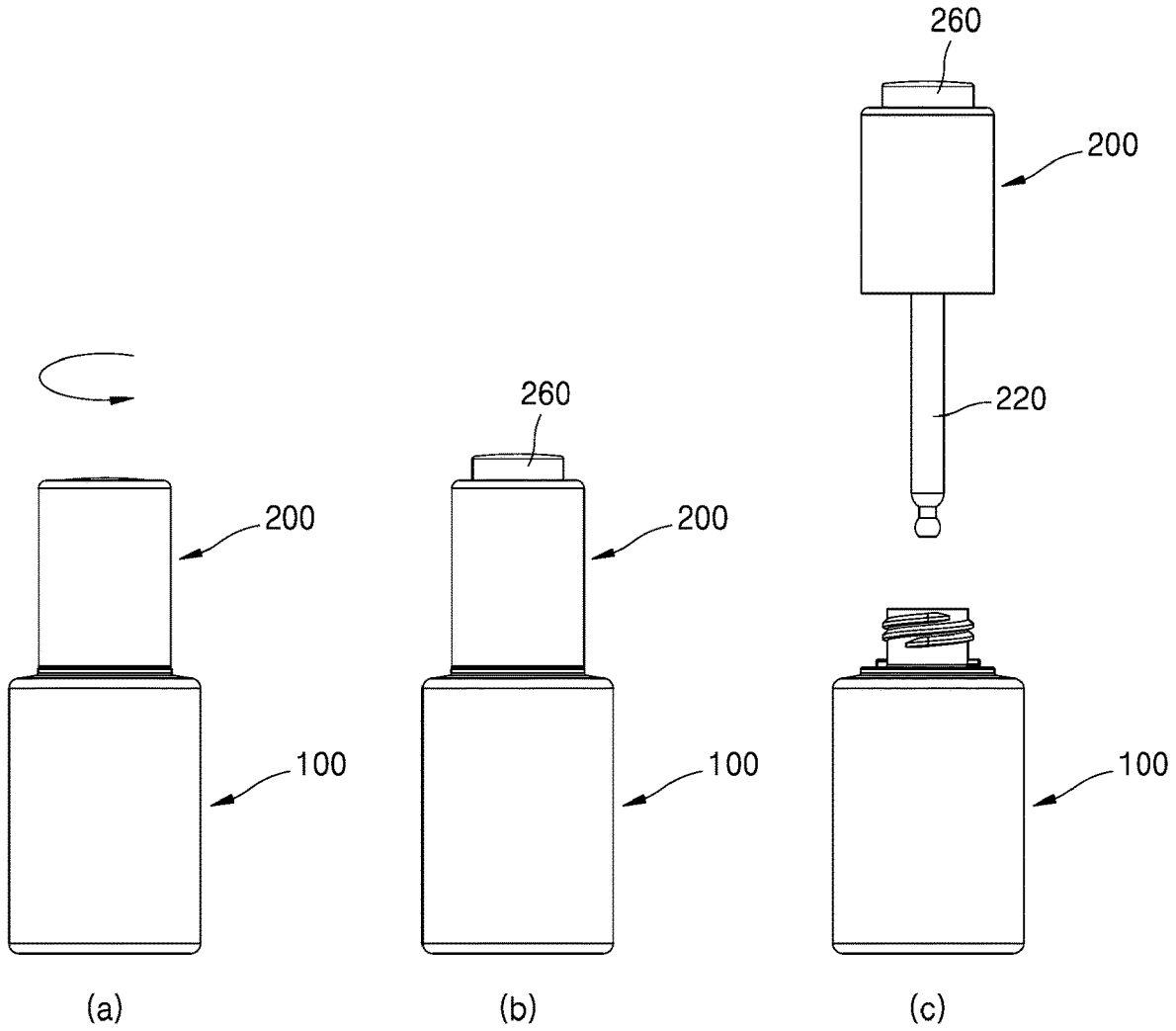
FIG. 10 illustrates side views showing usage examples of the container for discharging the contents thereof according to the present invention.

FIG. 10 illustrates side views showing usage examples of the container for discharging the contents thereof according to the present invention.

Referring to (a) and (b) of FIG. 10, in a state where the dropper 200 is completely coupled to the body 100, the second cap 280 rotates in the first direction by the user to allow the pressurizing part 260 to protrude outward therefrom, to suck the contents of the body 100 to the pipette 220, and to release the coupling state of the first cap 210 to the body 100.

Referring next to (c) of FIG. 10, the pipette 220 is drawn from the body 100 by the user, and the pressurizing part 260 is pressurized to discharge the sucked contents of the pipette 220 to a given region.

If the application of the contents of the body 100 is completed, further, the pipette 220 is inserted into the body 100 by the user, and the second cap 280 rotates in the second direction, so that the pressurizing part 260 is accommodated in the second cap 280 and the first cap 210 is coupled to the discharge portion 110 of the body 100.

As mentioned above, the preferred embodiment of the present invention has been disclosed in the specification and drawings. In the description of the present invention, special terms are used not to limit the present invention and the scope of the present invention as defined in claims, but just to explain the present invention. Therefore, persons skilled in the relevant art can appreciate that many modifications and variations are possible in light of the above teachings. It is therefore intended that the scope of the invention be limited not by this detailed description, but rather by the claims appended hereto.

The invention claimed is:

1. A container for discharging contents thereof, the container comprising:

a body for accommodating the contents therein; and a dropper having a first cap, detachably coupled to a top of the body, and configured to suck and discharge the contents accommodated within the body, the dropper comprising:

a pipette coupled to an inside of the first cap to allow at least a portion of the pipette to be accommodated in the body to suck the contents of the body; and button parts comprising:

a pressurizing part for changing an internal pressure of the pipette by a pressurization to discharge the contents sucked into the pipette;

an ascending and descending part ascended together with the pressurizing part according to a detachment of the dropper to allow the pressurizing part to protrude outward from the first cap; and an elastic part disposed between the pressurizing part and the ascending and descending part, the elastic part configured to:

compressedly deform when the pressurizing part is pressurized, and decompress by an elastic force when the pressurization is released, wherein the button parts are configured to be ascended by the elastic part to maintain a first separation distance between an underside of the pressurizing part and an underside of the ascending and descending part, and wherein the ascending and descending part has at least one or more ascending and descending protrusions, the first cap has at least one or more guide slits formed to given depths on an outer peripheral surface thereof to insert the ascending and descending protrusions thereinto, and the ascending and descending protrusions move along the at least one or more guide slits to allow the button parts to be ascended or descended.

2. The container according to claim 1, wherein the pressurizing part, the ascending and descending part, and the elastic part are made of a same material.

3. The container according to claim 1, wherein the pressurizing part protrudes from top of the first cap according to a separation of the dropper, and as the pressurizing part is pressurized, the elastic part is configured to be compressed to change the first separation distance between the underside of the pressurizing part and the underside of the ascending and descending part into a second separation distance.

4. The container according to claim 1, wherein an upper end portion of the ascending and descending part is inserted into the pressurizing part, the ascending and descending part has a first locking protrusion protruding from an outer peripheral surface of top end thereof, and the pressurizing part has a second locking protrusion protruding inward from an inner peripheral surface thereof, and wherein when the pressurization against the pressurizing part is released, the first locking protrusion is locked onto the second locking protrusion, preventing the pressurizing part from escaping from the ascending and descending part.

5. The container according to claim 1, wherein the ascending and descending part has a support peripheral portion protruding outward from an outer peripheral surface of a lower end thereof, and the elastic part is provided to a form of a bellows type member and seated onto top of the support peripheral portion to surround the outer peripheral surface of the ascending and descending part.

6. The container according to claim 5, wherein the pressurizing part has an extending portion extending from a bottom end periphery thereof to have a larger inner diameter than an inner diameter of top end periphery thereof, and an upper end periphery of the elastic part is accommodated in a separation space formed between an inner peripheral surface of the extending portion and the outer peripheral surface of the ascending and descending part.

7. The container according to claim 1, wherein the dropper further comprises a second cap coupled to the first cap to surround the first cap and rotating together with the button parts, and if the second cap rotates in a first direction or in a second direction opposite to the first direction, the dropper is separated from or coupled to the body.

8. The container according to claim 7, wherein if the pressurizing part is pressurized by a user to discharge the contents of the body, the ascending and descending part is supported against the ascending and descending protrusions and the at least one or more guide slits to allow the elastic part to provide the elastic force to the pressurizing part.

9. The container according to claim 7, wherein the second cap has vertical grooves formed on an inner peripheral surface thereof to extend up and down, and ends of the ascending and descending protrusions passing through the at least one or more guide slits are coupled to the vertical grooves, a the rotary force applied to the second cap is transferred to the button parts.

10. A container for discharging contents thereof, the container comprising:

a body for accommodating the contents therein; and a dropper having a first cap, detachably coupled to a top of the body, and configured to suck and discharge the contents accommodated within the body, the dropper comprising:

a pipette coupled to an inside of the first cap to allow at least a portion of the pipette to be accommodated in the body to suck the contents of the body; and button parts comprising:

a pressurizing part for changing an internal pressure of the pipette by a pressurization to discharge the contents sucked into the pipette;

an ascending and descending part ascended together with the pressurizing part according to a detachment of the dropper to allow the pressurizing part to protrude outward from the first cap; and an elastic part disposed between the pressurizing part and the ascending and descending part, the elastic part configured to:

compressedly deform when the pressurizing part is pressurized, and decompress by an elastic force when the pressurization is released, wherein the button parts are configured to be ascended by the elastic part to maintain a first separation distance between an underside of the pressurizing part and an underside of the ascending and descending part, wherein an upper end portion of the ascending and descending part is inserted into the pressurizing part, the ascending and descending part has a first locking protrusion protruding from an outer peripheral surface of top end thereof, and the pressurizing part has a second locking protrusion protruding inward from an inner peripheral surface thereof, and wherein when the pressurization against the pressurizing part is released, the first locking protrusion is locked onto the second locking protrusion, preventing the pressurizing part from escaping from the ascending and descending part.

11. The container according to claim 10, wherein the pressurizing part, the ascending and descending part, and the elastic part are made of a same material.

12. The container according to claim 10, wherein the pressurizing part protrudes from top of the first cap according to a separation of the dropper, and as the pressurizing part is pressurized, the elastic part is configured to be compressed to change the first separation distance between the underside of the pressurizing part and the underside of the ascending and descending part into a second separation distance.

13. The container according to claim 10, wherein the ascending and descending part has a support peripheral portion protruding outward from an outer peripheral surface of a lower end thereof, and the elastic part is provided to a form of a bellows type member and seated onto top of the support peripheral portion to surround the outer peripheral surface of the ascending and descending part.

14. The container according to claim 13, wherein the pressurizing part has an extending portion extending from a bottom end periphery thereof to have a larger inner diameter than an inner diameter of top end periphery thereof, and an upper end periphery of the elastic part is accommodated in a separation space formed between an inner peripheral surface of the extending portion and the outer peripheral surface of the ascending and descending part.

15. A container for discharging contents thereof, the container comprising:

a body for accommodating the contents therein; and a dropper having a first cap, detachably coupled to a top of the body, and configured to suck and discharge the contents accommodated within the body, the dropper comprising:

a pipette coupled to an inside of the first cap to allow at least a portion of the pipette to be accommodated in the body to suck the contents of the body; and button parts comprising:

a pressurizing part for changing an internal pressure of the pipette by a pressurization to discharge the contents sucked into the pipette;

an ascending and descending part ascended together with the pressurizing part according to a detachment of the dropper to allow the pressurizing part to protrude outward from the first cap; and an elastic part disposed between the pressurizing part and the ascending and descending part, the elastic part configured to:

compressedly deform when the pressurizing part is pressurized, and decompress by an elastic force when the pressurization is released, wherein the button parts are configured to be ascended by the elastic part to maintain a first separation distance between an underside of the pressurizing part and an underside of the ascending and descending part, wherein the ascending and descending part has a support peripheral portion protruding outward from an outer peripheral surface of a lower end thereof, and the elastic part is provided to a form of a bellows type member and seated onto top of the support peripheral portion to surround the outer peripheral surface of the ascending and descending part, and wherein the pressurizing part has an extending portion extending from a bottom end periphery thereof to have a larger inner diameter than an inner diameter of the top end periphery thereof, and an upper end periphery of the elastic part is accommodated in a separation space formed between an inner peripheral surface of the extending portion and the outer peripheral surface of the ascending and descending part.

16. The container according to claim 15, wherein the pressurizing part, the ascending and descending part, and the elastic part are made of a same material.

17. The container according to claim 15, wherein the pressurizing part protrudes from top of the first cap according to a separation of the dropper, and as the pressurizing part is pressurized, the elastic part is configured to be compressed to change the first separation distance between the underside of the pressurizing part and the underside of the ascending and descending part into a second separation distance.

* * * * *